US006845225B2

(12) United States Patent
Toyoda et al.

(10) Patent No.: US 6,845,225 B2
(45) Date of Patent: Jan. 18, 2005

(54) CLEANING SHEET, CLEANING METHOD, AND IMAGE FORMING APPARATUS

(75) Inventors: Yutaka Toyoda, Iwatsuki (JP); Naohisa Fujita, Iwatsuki (JP); Hitoshi Nanba, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 10 days.

(21) Appl. No.: 10/625,743

(22) Filed: Jul. 24, 2003

(65) Prior Publication Data

US 2004/0126158 A1 Jul. 1, 2004

(30) Foreign Application Priority Data

Dec. 10, 2002 (JP) ..... 2002-358355

(51) Int. Cl.[7] ..... G03G 15/20
(52) U.S. Cl. ..... 399/327
(58) Field of Search ..... 399/67, 320, 324, 399/325, 326, 327

(56) References Cited

U.S. PATENT DOCUMENTS 5,138,390 A * 8/1992 Miyabayashi et al. ..... 399/111
5,649,130 A * 7/1997 Nakajima et al. ..... 399/327
6,094,559 A * 7/2000 Otsuka et al. ..... 399/327

FOREIGN PATENT DOCUMENTS

| | | | |
|---|---|---|---|
| JP | 2-160276 | * | 6/1990 |
| JP | A 5-158375 | | 6/1993 |
| JP | B2 2651232 | | 5/1997 |
| JP | B2 2671148 | | 7/1997 |

* cited by examiner

*Primary Examiner*—Hoan Tran
(74) *Attorney, Agent, or Firm*—Oliff & Berridge, PLC

(57) ABSTRACT

Provided is a cleaning sheet adapted to clean a surface of a heating roll in a fixing device, which causes a recording sheet bearing a toner image formed of a magnetic toner containing a magnetic material to pass through the fixing device under a state in which the recording sheet is in press contact with the surface of the heating roll having arranged thereon a contact component in contact with the surface of the heating roll and heated to a fixing temperature to rotate, to perform fixing of the toner image, including a synthetic resin sheet with a thickness of 100 μm or more, which is made of a thermoplastic resin with a melting point higher than the fixing temperature and Rockwell hardness of M60 or more or thermosetting resin with Rockwell hardness of M60 or more.

18 Claims, 14 Drawing Sheets

JEOL JED-2001
NAME OF SAMPLE: P PAPER
ELAPSED TIME: 106.20 SECONDS
EFFECTIVE TIME: 100.00 SECONDS
MEASUREMENT TIME: 15 HOURS 41 MINUTES 51 SECONDS
FULL SCALE 512

JEOL JED-2001
NAME OF SAMPLE: BOISE X-9000 (TABLE)
ELAPSED TIME: 105.69 SECONDS
EFFECTIVE TIME: 100.00 SECONDS
MEASUREMENT TIME: 18 HOURS 02 MINUTES 50 SECONDS
FULL SCALE 512

Fig. 11

| No. | CLEANING SHEET | | | | | CLEANING EFFECT |
|---|---|---|---|---|---|---|
| | MATERIAL | THICKNESS (μm) | MELTING POINT (°C) | HARDNESS | TONER IMAGE | |
| 1 | POLYIMIDE | 80 | – | M115 | ABSENT | × |
| 2 | ↑ | 160 (TWO-PLY) | ↑ | ↑ | ↑ | ◎ |
| 3 | PET | 100 | 250 | M98 | ↑ | ○ |
| 4 | ↑ | 200 (TWO-PLY) | ↑ | ↑ | ↑ | ◎ |
| 5 | ↑ | 100 | ↑ | ↑ | PRESENT | ◎ |
| 6 | ↑ | 100 | ↑ | ↑ | ABSENT | ○ |
| 7 | ↑ | 100 | ↑ | ↑ | ↑ | ○ |
| 8 | ↑ | 103 | ↑ | ↑ | ↑ | ○ |
| 9 | ↑ | 134 | ↑ | ↑ | ↑ | ○ |
| 10 | COATED PAPER | 140 | – | – | ↑ | × |
| 11 | NON-WOVEN FABRIC WHOSE SURFACE IS MADE OF ACRYLIC FIBER | 450 | – | – | ↑ | × |

Fig. 12

| No. | CLEANING SHEET | | | | | CLEANING EFFECT |
|---|---|---|---|---|---|---|
| | MATERIAL | THICKNESS (μm) | MELTING POINT (°C) | HARDNESS | TONER IMAGE | |
| 5 | PET | 100 | 250 | M98 | PRESENT | × |
| 12 | ↑ | 300 (THREE-PLY) | ↑ | ↑ | ABSENT | ○ |
| 13 | ↑ | ↑ | ↑ | ↑ | PRESENT | ◎ |

ELAPSED TIME: 107.38 SECONDS
EFFECTIVE TIME: 100.00 SECONDS
MEASUREMENT TIME: 16 HOURS 44 MINUTES 51 SECONDS
FULL SCALE 512

ELAPSED TIME: 108.45 SECONDS
EFFECTIVE TIME: 100.00 SECONDS
MEASUREMENT TIME: 16 HOURS 44 MINUTES 46 SECONDS
FULL SCALE 512

CLEANING SHEET, CLEANING METHOD, AND IMAGE FORMING APPARATUS

FIELD OF THE INVENTION AND RELATED ART STATEMENT

The present invention relates to a cleaning sheet for cleaning a surface of a heating roll of a fixing device that fixes a toner image onto a recording sheet using the heating roll, a cleaning method using the cleaning sheet, and an image forming apparatus using the cleaning sheet. In particular, the present invention relates to a cleaning sheet capable of removing an aggregate mainly containing a magnetic material and adhering onto the surface of the heating roll, a cleaning method using the cleaning sheet, and an image forming apparatus using the cleaning sheet.

In the image forming apparatus such as a printer, a copier, a facsimile, or a multi-function machine employing an electrophotographic process, an electrostatic recording process, or the like, an image is generally formed by the electrophotographic process, in which an image containing a toner serving as a developer is formed and transferred onto a recording sheet directly or via an intermediate transfer member, and then the recording sheet bearing the toner image is conveyed to a fixing device to fix the toner image on the recording sheet.

In addition, as such a fixing device of the image forming apparatus, there is a type having a construction in which a recording sheet bearing a toner image is caused to pass through the fixing device under a state in which the recording sheet is press-contacted by a pressurizing member such as a pressurizing roll with the surface of the heating roll that is rotated after its cylindrical roll base material is heated to a fixing temperature by a heating source, thereby fixing the toner image.

However, in an image forming apparatus using a fixing device of this type, there is a deficiency in that, for example, a toner or paper powder adheres on the surface of the heating roll and such a adhering substance is transferred onto the recording sheet, or in that the recording sheet winds around the heating roll due to the existence of such a adhering substance.

Thus, in the past, in order to remove the adhering substance on the surface of the heating roll or the like of such a fixing device, there have been proposed a cleaning method and an image forming apparatus in which a cleaning sheet such as paper, with a fixed toner image formed thereon, is caused to pass through the fixing device (JP 2671148 B and JP 2651232 B) and a cleaning method in which, while keeping a surface temperature of a heating roll at a cleaning temperature higher than a fixing temperature, a cleaning sheet with a cleaning layer having adhesiveness formed thereon is caused to pass through the fixing device (JP 05-158375 A).

However, there further arises a problem concerning soil on a heating roll of a fixing device, which cannot be completely solved even by the cleaning method or the like in accordance with such proposals.

That is, in a type of fixing device which performs fixing of a toner image formed of a magnetic toner (e.g., magnetic one component toner) containing a magnetic material and which has a contact component such as a sheet peeling pawl or a temperature detection element coming into contact with a surface of a heating roll arranged thereon, an aggregate containing a magnetic material as a main body may adhere to the surface of the heating roll. In this case, there is a problem in that a low density part (white void in a worst case) is generated in an image portion, after fixing process which has passed through a position where the aggregate adheres, or in that image soil, which is adhesion of a toner on a non-image portion, after fixing process which has passed through the adhesion position, is generated. In particular, the image soil due to adhesion of a toner seems to be generated because the toner at the time of fixing adhering substances on an aggregate adhering to the heating roll and the toner is transferred to a non-image portion of a recording sheet which passes through the adhering position of the aggregate.

Then, since this aggregate firmly adheres on the surface of the heating roll, the aggregate cannot be removed even by a commonly known cleaning web or cleaning pad which is abutted against the heating roll to clean the same.

According to the studies of the inventor, it has been confirmed that the aggregate is generated as a toner or paper powder adhering on the heating roll accumulates. While the toner or paper powder adhering little by little on a contact part of the contact component such as a sheet peeling pawl, the adhering substance grows to be a large aggregate and gradually coheres thermally under heating according to a fixing operation. Then, apart or all of the aggregate is peeled from the contact part at the time of start of rotation or during rotation of the heating roll to be sent to a fixing nip portion between the heating roll and the pressurizing member and subjected to heating and pressurization, thereby adhering on the surface of the heating roll. In this case, the peeled aggregate does not adhere on the pressurizing member side when it passes through the fixing nip portion. It is surmised that this is because, since a thermal capacity of the heating roll is small compared with that of a pressurizing roll (on which an elastic layer is generally formed), a surface temperature of the heating roll falls due to the pressurizing roll after the aggregate has passed the fixing nip portion, and the aggregate easily adheres to the surface of the heating roll.

In addition, aggregates adhering on the sheet peeling pawl and the temperature detection element in the heating roll, which performed a fixing operation for several thousands sheets or more, were actually gathered, and an element analysis of the aggregates was performed. Then, as shown in FIGS. 14A and 14B, calcium, iron, silicon, and the like were mainly detected. FIG. 14A shows an analysis of an adhering substance on the temperature detection element, and FIG. 14B shows that of an adhering substance on the sheet peeling pawl. As to the respective element components, it is considered that calcium is derived from calcium carbonate contained as a filler for the recording sheet, iron is derived from ferrite serving as a magnetic material contained in the magnetic toner, and silicon is derived from silica oxide serving as an extraneous additive for the toner. From such a result, it has been found that the aggregate is different from an adhering substance generated by a toner (binder resin therefor) and paper powder (paper fiber, etc.) usually seen in the past.

Then, it has been confirmed that the aggregate peeled from this contact member firmly adheres on the surface of the heating roll and exists in a form of a very hard aggregate (in an initial stage, for example, an aggregate in a visually recognizable size as small as about 1 mm). Moreover, it is also confirmed that, in the case in which the aggregate on the heating roll is left as it is and a fixing operation is performed, the aggregate grows into a belt-like form along a direction of roll rotation while attracting a small amount of fogging toner existing on the recording sheet with the aggregate itself as a core.

OBJECT AND SUMMARY OF INVENTION

The present invention has been devised in view of such circumstances and provides a cleaning sheet which can easily remove a peculiar aggregate adhering to a surface of a heating roll on which a contact component of a fixing device is arranged, a cleaning method using the cleaning sheet, and an image forming apparatus using the cleaning sheet.

According to an aspect of the present invention, the cleaning sheet adapted to clean a surface of a heating roll in a fixing device, which causes a recording sheet bearing a toner image formed of a magnetic toner containing a magnetic material to pass through the fixing device under a state in which the recording sheet is in press contact with the surface of the heating roll having arranged thereon a contact component in contact with the surface of the heating roll and heated to a fixing temperature to rotate, to perform fixing of the toner image, includes a synthetic resin sheet, which has a thickness of 100 $\mu$m or more, which is made of a thermoplastic resin with a melting point higher than the fixing temperature and Rockwell hardness of M60 or more or thermosetting resin with Rockwell hardness of M60 or more, the sheet passing-through the fixing device under a state of being in press contact with the surface of the heating roll to thereby remove an aggregate mainly containing the magnetic material adhering to the surface of the heating roll.

As conceptually illustrated in FIGS. 1A and 1B, according to another aspect of the present invention, the cleaning method includes: causing a synthetic resin sheet 2 with a thickness of 100 $\mu$m or more, which is made of a thermoplastic resin with a melting point higher than a fixing temperature and Rockwell hardness of M60 or more or thermosetting resin with Rockwell hardness of M60 or more, to pass through a fixing device, which causes a recording sheet P bearing a toner image formed of a magnetic toner containing a magnetic material to pass through the fixing device under a state in which the recording sheet P is in press contact with a surface of a heating roll 1 having arranged thereon a contact component 2 to be in contact with the surface of the heating roll and heated to the fixing temperature to rotate, to perform fixing of the toner image under a state in which the synthetic resin sheet 3 is in press contact with the surface of the heating roll 1 to remove an aggregate 4 mainly containing the magnetic material adhering to the surface of the heating roll 1. In the figures, reference numeral 5 denotes a pressurizing member adapted to bring the recording sheet P in press contact with the heating roll 1.

According to such a cleaning sheet and a cleaning method, by causing the synthetic resin sheet 3 to pass through the fixing device, the aggregate 4 adhering to the surface of the heating roll 1 is peeled from the surface of the roll to adhere on the sheet, whereby the aggregate 4 is removed (FIG. 1B).

Although a mechanism with which the aggregate is removed is not always clear, it is surmised as described below. That is, since the synthetic resin sheet 3 has heat resistance against a fixing temperature and is relatively hard, it never melts and is less likely to deform when it is brought into press contact with the surface of the heating roll 1 under a state in which the aggregate exists between the synthetic resin sheet 3 and the surface of the heating roll 1. Consequently, most of a pressure applied to the synthetic resin sheet 3 at the time of press contact is directly applied to the aggregate. As a result, the aggregate itself (and the surface of the heating roll 1 as well in some cases) is distorted locally and destroyed partially or entirely, whereby a gap is generated between the aggregate and the surface of the heating roll 1, and an adhesion of the aggregate and the surface of the heating roll 1 falls. Then, it is considered that the aggregate adheres to the synthetic resin sheet 3 under a state in which the aggregate slightly cuts into the synthetic resin sheet 3 that is softer than the surface of the heating roll 1, and the aggregate is peeled from the surface of the heating roll 1. Incidentally, it has been confirmed that, in the case in which an ordinary recording sheet of paper is caused to pass through the fixing device, a part of the sheet in contact with the aggregate simply deforms into a depressed shape (FIG. 15), and the aggregate cannot be removed.

Here, a melting point in the synthetic resin sheet including thermoplastic resin is a crystalline melting point, which is measured by a measuring method of the differential scanning calorimetry (DSC). The fixing temperature is a temperature which is set upon heating the heating roll to a temperature suitable for the fixing of a toner image in the fixing device (or an actual temperature of the surface of the heating roll). In the case in which this melting point is equal to or lower than the fixing temperature, the synthetic resin sheet softens and melts when it is brought into press contact with the surface of the heating roll, which is heated, and such an effect as to remove the aggregate is not effectively removed. In addition, containing a magnetic material as a main body means that the magnetic material is contained in the aggregate with a relatively high content such as 90 weight % or more.

Rockwell hardness in the synthetic resin sheet including thermoplastic resin or thermosetting resin is measured by a measuring method according to JIS K7202. If the Rockwell hardness is smaller than M68, there is a problem in that, for example, a high pressure cannot be applied to the aggregate in the fixing nip portion. The Rockwell hardness is preferably M90 or more.

A thickness d of the synthetic resin sheet is 100 $\mu$m or more, preferably more than 100 $\mu$m rather than 100, and more preferably 150 $\mu$m or more. The larger the thickness d is, the more the removal effect against an aggregate increases. If the thickness is less than 100 $\mu$m, the removal effect cannot be obtained. In addition, setting of the thickness d may be realized by using one (molded) sheet, or by stacking and adhering plural sheets. Note that, an upper limit value of the thickness d is not specifically limited as long as the synthetic resin sheet can pass through the fixing device, and it is, for example, about 400 $\mu$m. In addition, the synthetic resin sheet to be caused to pass through the fixing device is preferably of a size having a width (in a conveying direction) equivalent to a maximum range of fixing of the heating roll in order to surely remove the aggregate.

Examples of the thermoplastic resin sheet satisfying the conditions of the melting point and the Rockwell hardness include a sheet including polyethylene terephthalate (PET), polybutylene terephthalate (PBT), or the like. In addition, examples of the thermosetting resin sheet satisfying the conditions of the Rockwell hardness include a sheet including polyimide (PI) or the like. Although it is unnecessary to apply specific surface treatment to the surface of the sheet, a conductive layer, which is effective for preventing electrostatic absorption, maybe formed, if necessary, for example, in order to give the sheet peelability from the heating roll or to secure satisfactory conveyability of the sheet.

The synthetic resin sheet 3 is usually caused to pass between the heating roll 1 and the pressurizing member 5 used in fixing. However, if necessary, a pressurizing member dedicated solely for the sheet passing may be separately arranged in a portion on the surface of the heating roll 1, the portion not related to a fixing operation, and the synthetic resin sheet 3 may be caused to pass between the separately arranged pressurizing member and the heating roll 1. In addition, one synthetic resin sheet 3 is usually sufficient, but plural synthetic resin sheets 3 may be provided, if necessary.

In the above-mentioned cleaning method, passing of the synthetic resin sheet 3 may be performed, for example, under a state in which the heating roll 1 is not heated. However, it is preferable that the passing of the synthetic resin sheet 3 is performed under the same conditions as those at the time of fixing.

In this case, since special control different from the fixing conditions is unnecessary, and passing of the synthetic resin sheet 3 can be performed in the same condition as the ordinary fixing operation, removal of the aggregate can be easily performed. Moreover, since the heating roll is heated, removal of the aggregate is facilitated. Here, "the same conditions as those at the time of fixing" means that conditions equal to the set conditions at the time of fixing are adopted without specifically changing a fixing temperature and a fixing speed (rotation speed of the heating roll 1). In addition, the conditions also include the fixing condition of, for example, fixing an overhead projector (OHP) sheet, in which a fixing speed or the like is different.

In addition, in the case in which the synthetic resin sheet 3 is caused to pass through the fixing device under the same conditions as those at the time of fixing, it is preferable to use the synthetic resin sheet 3 having a specific dot-like or line-like toner image formed on one side thereof.

Consequently, a toner forming the toner image is changed into a melted state through heating of the heating roll, and the aggregate, which is under a state in which it is easily peeled from the surface of the heating roll 1 by pressurization from the synthetic resin sheet as described above, is easily adhered to the sheet side and removed. A toner image may be a fixed toner image after fixing, or an unfixed toner image. In the case of the fixed toner image, it melts again through heating of the heating roll 1. In addition, the specific dot-like or line-like toner image is not a solid image but a dot-like or a thin line-like image which has a gap (non-image part) even in the case in which the image is opposed to the aggregate (this is also true for an image forming apparatus to be described below). Preferably, it is an image in which the toner of the image melts to be spread out at the time of heating of the heating roll and a gap with which a slight area of non-image part may be left exists. In addition, in the case in which the synthetic resin sheet 3 is relatively thin, formation of such a toner image is beneficial for increasing the removal effect against an aggregate. Further, the synthetic resin sheet becomes less likely to wind around the heating roll 1 regardless of the fact that the toner image exists.

On the other hand, as illustrated in FIGS. 1A and 1B, according to another aspect of the present invention, the image forming apparatus includes:

an image producing device which forms a toner image formed of a magnetic toner containing a magnetic material and transfers the toner image to a recording sheet; and a fixing device which causes the recording sheet on which the toner image is born by the image producing device to pass through the fixing device under a state in which the recording sheet is in press contact with a surface of a heating roll, which has arranged thereon a contact component in contact with the surface of the heating roll and is heated to a fixing temperature to rotate, to perform fixing of the toner image, the image forming apparatus having an operation mode that causes a synthetic resin sheet 3 with a thickness of 100 μm or more, which is made of a thermoplastic resin with a melting point higher than the fixing temperature and Rockwell hardness of M60 or more or thermosetting resin with Rockwell hardness of M60 or more to pass through the fixing device under a state in which the synthetic resin sheet 3 is in press contact with the surface of the heating roll 1, with the operation mode executed at a predetermined time.

According to such an image forming apparatus, the aggregate 4 adhering to the surface of the heating roll 1 is peeled from the surface of the heating roll 1 and adheres on the synthetic resin sheet 3 by causing the synthetic resin sheet 3 to pass through the fixing device according to execution of the above-mentioned operation mode, whereby the aggregate 4 is removed (FIG. 1B).

The operation mode is one of operation forms of the image forming apparatus which are set in advance in order to perform passing of the synthetic resin sheet 3. This operation mode only has to be set such that, for example, instruction operation from an operation panel and input of an instruction from a host computer side or the like are possible. In addition, the synthetic resin sheet 3 is the same as the synthetic resin sheet in the cleaning method described above.

Such an image forming apparatus may be constituted such that, at the time of execution of the operation mode, for example, the heating roll 1 of the fixing device is simply rotated under a state in which it is not heated. However, preferably, the image forming apparatus is constituted such that the fixing device operates under the same conditions as those at the time of fixing.

In this case, as in the case of the above-mentioned cleaning method, since special control different from the fixing conditions is unnecessary, and passing of the synthetic resin sheet can be performed in the same manner as the ordinary fixing operation, removal of the aggregate can be performed easily. Moreover, since the heating roll is heated, removal of the aggregate is facilitated.

In addition, in the case in which the fixing device is operated under the same conditions as those at the time of fixing, it is desirable that a specific dot-like or line-like fixed toner image is formed on one side of the synthetic resin sheet.

Consequently, as in the case of the above-mentioned cleaning method, the toner forming the fixed toner image melts again through heating of the heating roll, and the aggregate in a state of being easily peeled from the surface of the heating roll by pressurization from the synthetic resin sheet as described above, is easily attracted to the sheet side and removed. The fixed toner image is a toner image which has already been fixed.

Moreover, it is desirable that, in the case in which the fixing device is operated under the same conditions as those at the time of fixing, upon the execution of the operation mode, the synthetic resin sheet is conveyed to the image producing device to form a specific dot-like or line-like unfixed toner image on one side of the sheet, and the synthetic resin sheet having the toner image formed thereon is conveyed to the fixing device.

Consequently, as in the case of the above-mentioned cleaning method, the unfixed toner image melts through heating of the heating roll, and the aggregate in a state of being easily peeled from the surface of the heating roll by pressurization from the synthetic resin sheet as described above, is easily attracted to the sheet side and removed. Note that the unfixed toner image is fixed on the synthetic resin sheet in the fixing device.

In addition, the operation mode in the above-mentioned image forming apparatus only has to be executed at a predetermined time. The execution time of the operation mode includes not only a time when the aggregate has already adhered to the surface of the heating roll but also a time when it is anticipated that the aggregate has started to adhere.

More specifically, it is desirable to execute the operation mode based upon judgment of a user. In this case, since the user recognizes that image failure (generation of the low image density part, the image stained with toner, etc.) as described above occurs periodically due to adhesion of the aggregate in association with a peripheral length of the heating roll, the operation mode is executed at a point when this image failure is regarded as a problem for the user.

In addition, it is desirable that the operation mode is executed at the time when a replacement part is mounted. In this case, replacement work of the replacement part can also be performed as removal work of the aggregate. The replacement part means a component to be detachably mounted to an image forming apparatus main body, which is required to be replaced when the component itself has fulfilled its useful life or when consumables are supplied to the component. Examples of the replacement part include a toner cartridge, a process cartridge including an image bearing member such as a photosensitive member, and the like.

Moreover, it is desirable that, at the time of image formation for test or confirmation of setting, the operation mode is executed by using the synthetic resin sheet as a recording sheet therefor. In this case, the user can perform removal work of the aggregate simultaneously with image forming work for test or confirmation of setting. The image forming work for test includes one which is performed by a user himself/herself as required, one which is performed by a serviceman at the time of maintenance work, or the like. The image forming work for confirmation of setting is work for confirming contents of present setting of the image forming apparatus.

Then, in the above-mentioned image forming apparatus, it is preferable that an accommodating section adapted to store the synthetic resin sheet is provided in the image forming apparatus. In this case, since the accommodating section is provided in the image forming apparatus, the user can immediately take out the synthetic resin sheet and execute the operation mode to perform the removal work of the aggregate promptly and easily. The accommodating section only has to be set in a portion where there is a space in which the synthetic resin sheet can be stored (e.g., a sheet cassette, and the back of an opening/closing door).

In addition, the synthetic resin sheet may be enclosed together with accessories for the image forming apparatus and stored. In this case, the user can take out the synthetic resin sheet out of the accessories stored by his/her side and execute the operation mode to perform the removal work of the aggregate relatively promptly. The accessories are, for example, an operation manual of the image forming apparatus, a sample set of a recording sheet, and the like.

Moreover, the synthetic resin sheet may be enclosed together with replacement parts for the image forming apparatus and stored. In this case, the user can perform the removal work of the aggregate simultaneously with the replacement work of the replacement parts.

In addition to the above, the synthetic resin sheet may be delivered to the user according to notification from the user to a service center (an agency dealing in the product or a support company). In this case, the user can purchase the synthetic resin sheet when it is actually required, which is economical.

Note that, in the cleaning method and the image forming apparatus, the heating roll is preferably a cylindrical roll, which is relatively thin. In the case in which such a heating roll is applied to the image forming apparatus, when the synthetic resin sheet passes through the fixing device, as described above, the aggregate itself is distorted by pressure applied by the sheet and, in addition, the heating roll is distorted locally. As a result, the gap between the aggregate and the surface of the heating roll is more likely to be generated and, eventually, the aggregate can be removed easily.

The thin heating roll may be any heating roll as long as it shows a physical property that the surface of the heating roll is distorted (deformed) locally when the synthetic resin sheet passes through the fixing device under a state in which the aggregate exists between the surface of the heating roll and the synthetic resin sheet. More specifically, in the case in which a roll base material (cored bar) made of aluminum is used for the heating roll, a thinnest surface part thereof is 0.9 mm or less and, in the case in which a roll base material made of iron is used, a thinnest surface part is 0.3 mm or less.

In addition, the recording sheet may be any recording sheet as long as it is capable of transferring and fixing a toner image. For example, the recording sheet is plain paper, coated paper, an OHP sheet, a postcard, or the like. In the case in which a sheet containing a relative large amount of calcium carbonate as a filler is used as the recording sheet, the aggregate tends to be generated as described later.

As described above, according to the cleaning sheet, the cleaning method, and the image forming apparatus of the present invention, the aggregate, which mainly contains a magnetic material, adhering to the surface of the heating roll on which the contact component of the fixing device is arranged can be removed easily. Consequently, it becomes possible to obtain a satisfactory fixed image in which a periodical generation of the low density part (white void) or image stained with toner due to the existence of such an aggregate can be avoided.

BRIEF DESCRIPTION OF THE DRAWINGS

A preferred embodiment of the present invention will be described in detail based on the following figures, wherein:

FIGS. 1A and 1B are conceptual views schematically showing a cleaning method of the present invention: in which FIG. 1A shows a state before a synthetic resin sheet is caused to pass a fixing device, and FIG. 1B is shows a state at the time when the synthetic resin sheet is being caused to pass the fixing device;

FIG. 11 is a table showing conditions of a test for cleaning effect and a result thereof in the embodiment;

FIG. 12 is a table showing conditions of another test for cleaning effect and a result thereof in the embodiment;

DETAILED DESCRIPTION OF THE PREFERRED EMBODIMENT

Figure 1A:
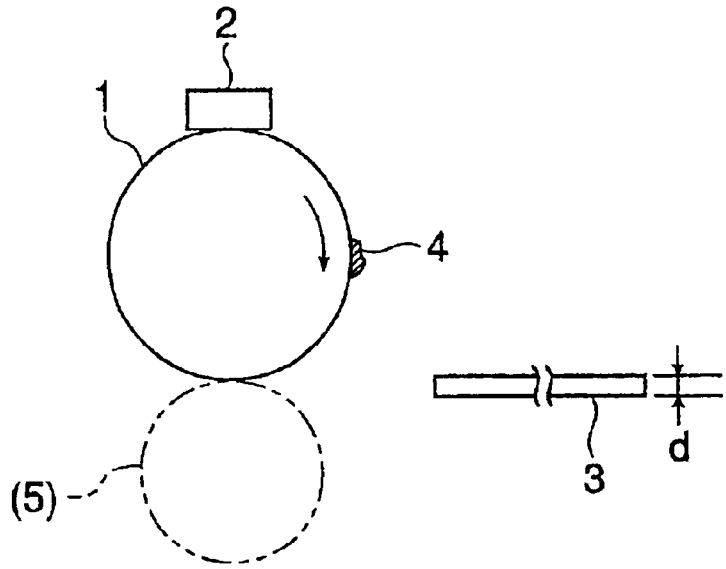
Figure 1B:
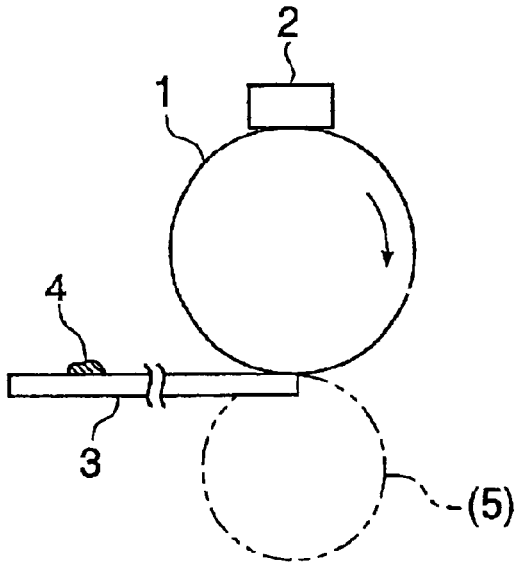
Figure 2:
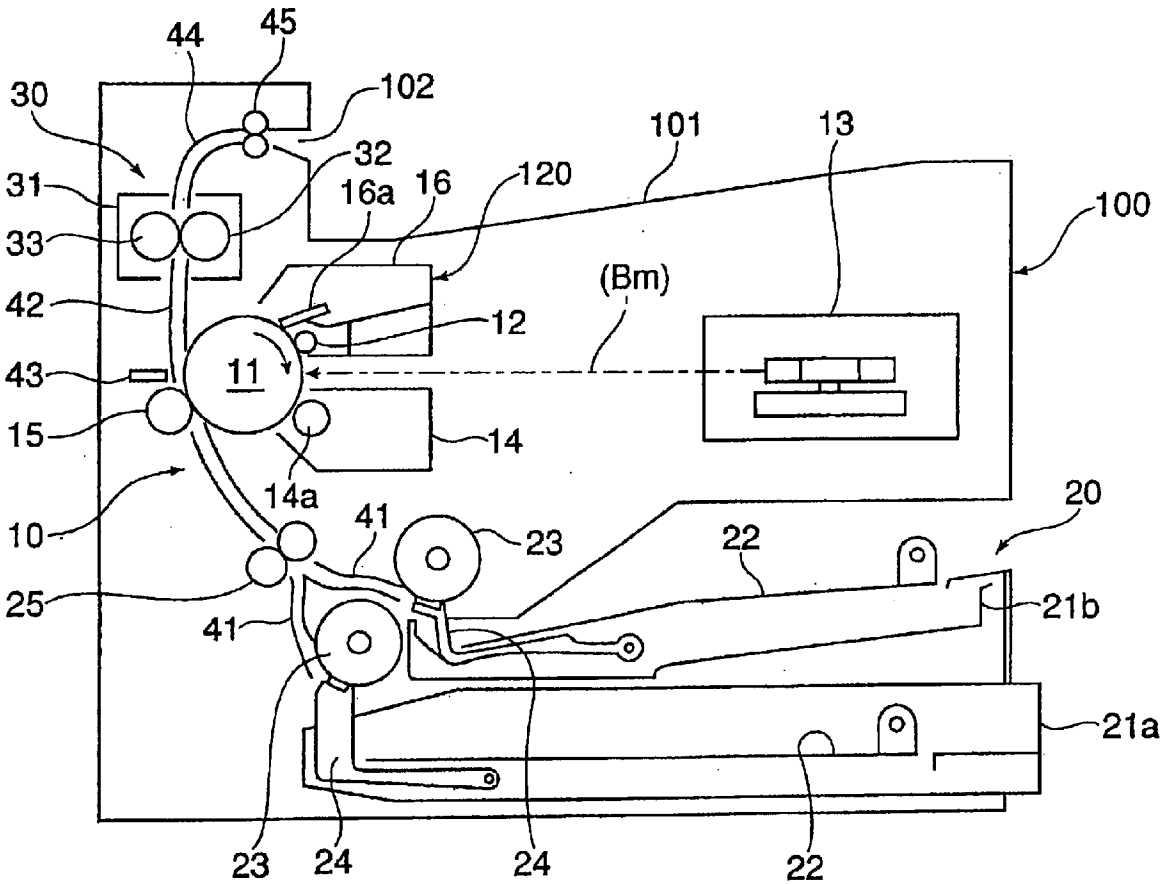
FIG. 2 is a diagram showing a main part of a printer in accordance with an embodiment.

FIG. 2 shows a printer in accordance with an embodiment to which the present invention is applied.

In this printer, a main part thereof includes a main body 100 including a support frame, an armor cover, and the like, and an image producing device 10, a sheet feeding device 20, and a fixing device 30 which are arranged inside this main body 100.

The image producing device 10 includes of a photosensitive drum 11, a charging device 12, a latent image forming device 13, a developing device 14, a transfer device 15, a cleaning device 16, and the like. In particular, in this image producing device 10, the photosensitive drum 11, the charging device 12, the developing device 14, and the cleaning device 16 are unitized to be formed as a process cartridge 120 which is detachably mounted on the main body 100. The process cartridge 120 is replaced with a new process cartridge based upon replacement standard information such as a deterioration timing of the photosensitive drum 11 and a developer consumed timing of the developing device 14.

In this image producing device 10, a photosensitive layer including an organic photoconductive material or the like is formed on a peripheral surface of a cylindrical rotation support body, and a peripheral surface (photosensitive layer) of the photosensitive drum 11, which is driven to rotate at a predetermined speed in a direction of arrow by a not-shown drive unit, is uniformly charged by the charging device 12. The charging device 12 applies a charging voltage to a charging roll rotating in contact with the peripheral surface of the photosensitive drum 11, thereby charging the peripheral surface of the photosensitive drum 11. In this charging device 12, since the photosensitive layer of the photosensitive drum 11 has a negative charging property, a charging bias, in which an alternating current is superimposed on a direct current of a negative polarity, is applied to the charging roll, whereby charging is performed.

An electrostatic latent image according to image information is formed on the peripheral surface of the photosensitive drum 11, which is uniformly charged in this way, by the latent image forming device 13. The latent image forming device 13 modulates and emits light (light beam) Bm from a light emission source such as a semiconductor laser based upon an image signal, which is obtained after subjecting image information inputted from an original reading apparatus, an externally connected apparatus, a storage medium, or the like. Then, the latent image forming device 13 is adapted to guide the light Bm to the peripheral surface of the photosensitive drum 11 via a predetermined optical component (lenses, reflection mirror, rotating polygon mirror, etc.) to scan and expose the peripheral surface of the photosensitive drum 11, thereby forming a latent image.

The electrostatic latent image formed on the photosensitive drum 11 is developed by the developing device 14 to be visualized. The developing device 14 is a one component developing device using a one component developer including a magnetic toner. In the developing device 14, the magnetic toner, which is carried while being agitated by an agitation and conveyance member such as an agitator rotating inside the main body storing the one component developer, is supplied to a developing roll 14*a* rotating in a position opposed to the photosensitive drum 11. Thereafter, the magnetic toner is regulated to a state in which it is supported on the developing roll 14*a* in a thin layer shape while being subjected to triboelectrification by an abutting blade abutting against a peripheral surface of the developing roll 14*a* and is conveyed to a development area opposed to the photosensitive drum 11 in that state. A development bias (voltage in which an alternating current is superimposed on a direct current) is applied to the developing roll 14*a*. Then, the magnetic toner electrostatically adheres only on a latent image part of the photosensitive drum 11, whereby a toner image including the magnetic toner is formed on the photosensitive drum.

The toner image on the photosensitive drum 11 formed in this way is electrostatically transferred onto a recording sheet P, which is conveyed and supplied from the sheet feeding device 20, by the transfer device 15. The transfer device 15 is adapted to pass the recording sheet P through a portion between the transfer roll and the photosensitive drum 11 (nip portion), while a charging voltage having a polarity (in this embodiment, a positive polarity) opposite to a charging polarity (in this embodiment, a negative polarity) is being applied to a toner on a transfer roll rotating in contact with the peripheral surface of the photosensitive drum 11, thereby electrostatically transferring the toner image onto the recording sheet P. A residual toner or the like is removed from the peripheral surface of the photosensitive drum 11 after transferred by a cleaning blade 16*a* of the cleaning device 16, and the surface is cleaned.

The sheet feeding device 20 is adapted to stack and store plural recording sheets P of predetermined sizes on trays 22 of sheet cassettes 21*a* and 21*b* inserted in the main body 100 removably (detachably), and deliver the recording sheets P one by one from the top with a delivery roll 23, a handling member (e.g., retard pad arm) 24, and the like. In addition, the recording sheet P delivered from these sheet cassettes 21*a* and 21*b* is once stopped by registration rolls (pair) 25, which is arranged in a sheet conveying path 41 for sheet feeding connecting the sheet feeding device 20 and (a transfer portion of) the image producing device 10 and rotates. Thereafter the recording sheet P is delivered according to the timing of the transfer and is fed into the part between the photosensitive drum 11 and the transfer roll while being guided by a conveyance guide constituting the sheet conveying path 41.

The recording sheet P having the toner image transferred thereon in the transfer portion (nip portion of the photosensitive drum and the transfer roll) of the image producing device 10 is peeled from the photosensitive drum 11 while being subjected to charge elimination by a charge elimination device, which is arranged in a sheet conveying path 42 for relay connecting the image producing device 10 and the fixing device 30. Thereafter, the recording sheet P is fed into the fixing device 30 while being guided by a conveyance guide constituting the sheet conveying path 42.

Figure 3:
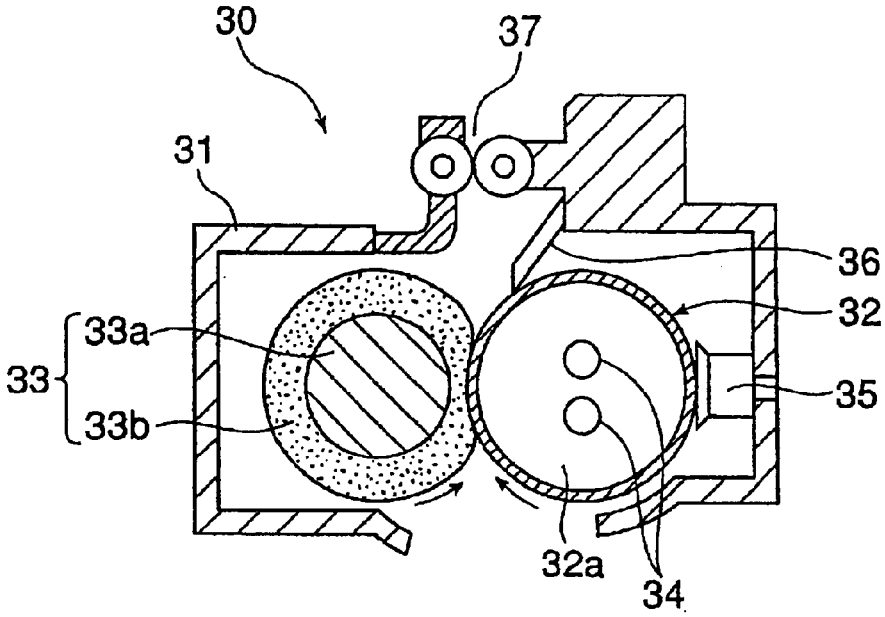
FIG. 3 is a schematic sectional view showing a main part of a fixing device.

As shown in FIGS. 2 and 3, the fixing device 30 is adapted to pass the recording sheet P through a portion (fixing nip portion) between a heating roll 32 and a pressurizing roll 33, which are arranged in a housing 31 so as to rotate in a press contact state, thereby heating and pressurizing the toner image to fix it on the recording sheet P.

As shown in FIG. 3, the heating roll 32 in the fixing device 30 includes an iron cored bar 32*a* of a thin cylindrical shape and a surface release layer formed on a surface of this cored bar 32*a*. A halogen lamp 34 serving as a heating source is arranged inside a hollow of the cored bar 32*a*. In addition, this heating roll 32 is rotatably supported by the housing 31 and is adapted to be driven to rotate in a direction of arrow at a predetermined speed by a not-shown drive unit. On the other hand, the pressurizing roll 33 includes a metal cored bar 33*a*, an elastic layer 33*b* formed on a surface of this cored bar 33*a*, and a surface release layer 33*c* formed on a surface of this elastic layer 33*b*. In addition, this pressurizing roll 33 is supported rotatably by a support frame, which is supported swingably by the housing 31, and is adapted to be brought into press contact with the surface of the heating roll 31 with a predetermined pressure by a not-shown pressurizing spring via the support frame.

On a surface of the heating roll 32, a temperature detection element (temperature sensor) 35 for detecting temperature of the surface of the heating roll 32 is arranged under a state in which it is in contact with the surface. Energization to the halogen lamp 34 is controlled based upon a result of the detection of this temperature detection element 35, whereby the heating roll 32 is heated to raise a surface temperature thereof to a predetermined temperature (mainly a fixing temperature) and the surface temperature is kept. In addition, on the surface of the heating roll 32, a number of sheet peeling pawls 36, which complementarily peel the recording sheet P after fixing operation from the surface of the heating roll 32, are arranged in contact with the surface at points in an axial direction of the heating roll 32. Reference numeral 37 in FIG. 3 denotes a discharge roll for discharging the recording sheet P after fixing operation to the outside of the housing 31.

The recording sheet P after having the toner image fixed thereon in this fixing device 30 is, while being guided by a conveyance guide constituting a sheet conveying path 44 for sheet discharge connecting the fixing device 30 and a sheet discharge tray section 101 formed on an upper surface side of the main body 100, discharged onto the sheet discharge tray section 101 through an outlet 102 by discharge rolls (pair) 45, which is arranged in the middle of the sheet conveying path 44 and rotates. Through the above processes, image forming (print) for one recording sheet P is performed.

Then, in this printer, there is provided an operation mode (hereinafter simply referred to also as "roll cleaning mode") for causing a specific synthetic resin sheet described later (hereinafter simply referred to also as "cleaning sheet") 60 to pass the surface of the heating roll 32 in the fixing device 30 at predetermined timing under a state in which the cleaning sheet 60 is in press contact with the surface by the pressurizing roll 33. In the case in which this cleaning mode is executed, the cleaning sheet 60 is set and stored in the sheet cassettes 21*a* and 21*b*.

Figure 4:
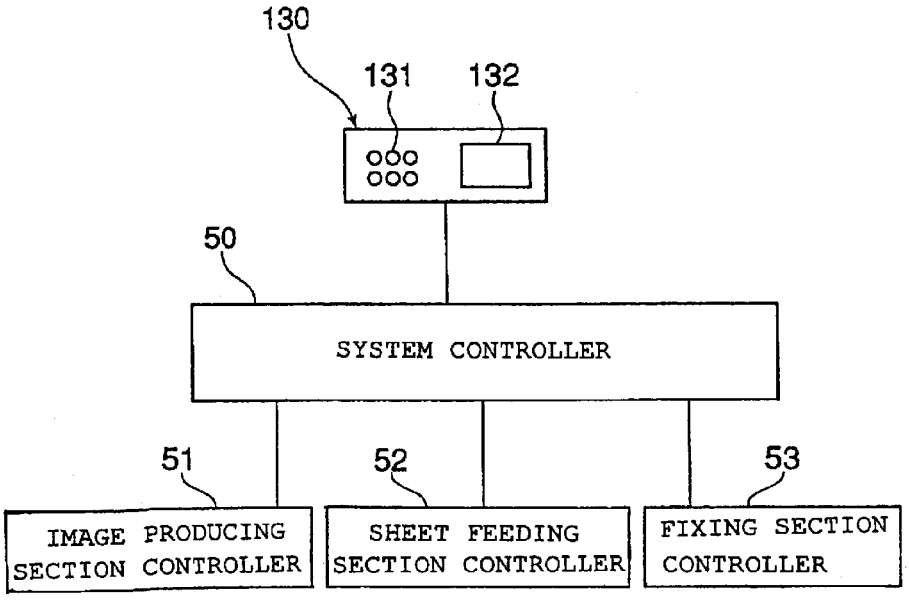
FIG. 4 is a block diagram showing a structure of a control system.

As shown in FIG. 4, the printer is provided with an operation panel 130, which is arranged in a predetermined position of a main body 100 of the printer and includes an input key 131 for performing operation instruction for the printer and input instruction for condition setting or the like, and a display screen 132 of a touch panel type for displaying predetermined information and the like. A user of the printer gives an instruction for executing the roll cleaning mode according to judgment of the user by appropriately operating the input key 131 or the display screen 132. The operation panel 130 is connected to a system controller 50 constituted by a microcomputer or the like which generally manages and controls operations and the like of the entire printer. In addition, to this system controller 50, are connected an image producing section controller 51 for controlling operations of the image producing device 10, a sheet feeding section controller 52 for controlling operations of the sheet feeding device 20, a fixing section controller 53 for controlling operations of the fixing device 40, and the like.

The system controller 50 is set when the execution of the cleaning mode is instructed, the image producing device 10, the sheet feeding device 20, and the fixing device 40 operate under required conditions, respectively, thereby finally passing the cleaning sheet 60 through the surface of the heating roll 32 in the fixing device 40 so as to be brought into press contact with the surface. That is, at the time of execution of the cleaning mode, the system controller 50 sends a control signal for the mode to the respective controllers 51 to 53, and carries out control to operate the sheet feeding device 20 so as to convey and supply the cleaning sheet 60 at predetermined timing, operate the image producing device 10 so as to form a toner image on the cleaning sheet 60 as required, and operate the fixing device 30 so as to cause the cleaning sheet 60 to pass in press contact with the heating roll 32 under predetermined conditions.

Figure 5A:
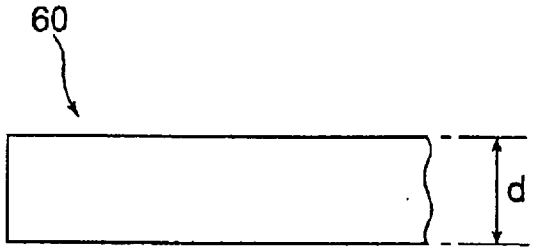
FIG. 5A illustrates a part of a cleaning sheet of a one-ply structure.
Figure 5B:
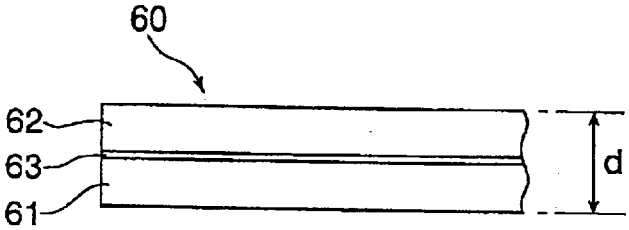
FIG. 5B illustrates a part of a cleaning sheet of a two-ply structure.

As the cleaning sheet 60, a synthetic resin sheet with a thickness d of 100 $\mu$m or more including a thermoplastic resin with a melting point higher than a fixing temperature and Rockwell hardness of M60 or more, or thermosetting resin with Rockwell hardness of M60 or more is used. The cleaning sheet 60 having this thickness d preferably has a structure provided with the thickness d as one sheet as shown in FIG. 5A. However, the cleaning sheet 60 may be a sheet with a structure in which the thickness d is secured by adhering two synthetic resin sheets 61 and 62 with adhesive member 63 such as an adhesive or a couple-face tape. As a size of this cleaning sheet 60, an A3 size or an A4 size is adopted if a maximum paper passing size of the printer is A3.

In addition, a surface of the cleaning sheet 60 maybe a surface as obtained by the sheet formation. However, preferably, a conductive layer including polyester resin or the like in which a conductive material is contained to give it electric conductivity is formed at least on a surface of a side to be brought into contact with the surface of the heating roll. Furthermore, it is also preferable to form a mat layer including polyester resin or the like in which a mat agent (resin particles) or the like is formed on the conductive layer.

Figure 6:
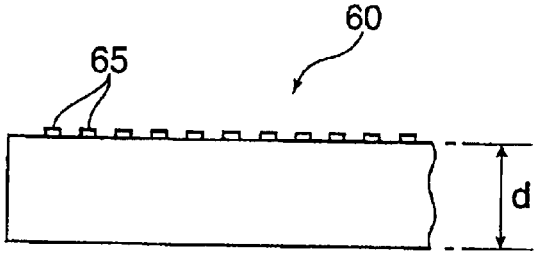
FIG. 6 is an explanatory view showing a part of a cleaning sheet on which a toner image is formed.
Figure 7A:
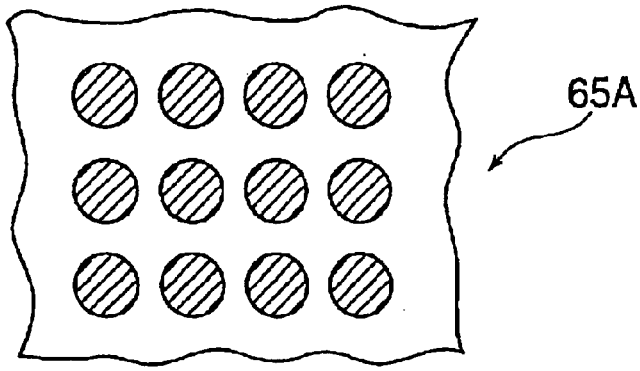
FIG. 7A is an explanatory plan view showing an example of a dot-like toner image.
Figure 7B:
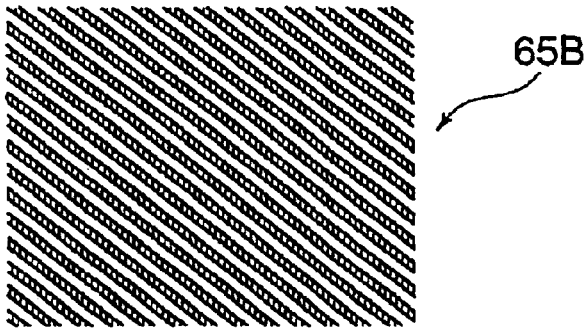
FIG. 7B is an explanatory plan view showing an example of a line-like toner image.

Further, in the cleaning sheet 60, as shown in FIG. 6, a dot-like or line-like toner image 65 is formed at least on the surface of the side to be brought into contact with the surface of the heating roll, if necessary. It is assumed that the toner image 65 is formed and fixed in advance or is formed by the image producing device 10. The dot-like toner image 65A is an image in which dots are interspersed as illustrated in FIG. 7A, and is formed with an image density of 25 to 75%. In addition, the line-like toner image 65B is an image in which thin lines are arranged in parallel with each other at equal intervals toward a diagonal direction with respect to a sheet conveying direction as illustrated in FIG. 7B, and is formed of, for example, a parallel line pattern with the number of screen lines of 106 to 141 per inch. Content of a pattern of such a dot-like or line-like toner image is stored in a storage device of an image processing apparatus or the like, which sends an image signal to the latent image forming device 13, in advance.

Moreover, the cleaning sheet 60 is stored by placing it in a holder serving as a storing portion and detachably attaching the holder on the back of a bottom surface of the sheet cassette 20*a* in the sheet feeding device 20. Therefore, when the cleaning sheet 60 is used, the holder is detached from the back of the bottom surface of the sheet feeding cassette 20*a*, and the cleaning sheet 60 is taken out of the holder.

Then, the cleaning mode is executed as described below.

First, when a user looks at an obtained image and finds a low density part (or white void in a worse case) or image soil present periodically in the same position, the user judges that the cleaning mode is to be executed. Criteria for the judgment, content of execution of the cleaning mode, and the like are made open to the user in the form of a manual or the like for the printer.

When the user judges that execution of the cleaning mode is necessary, first, the user takes out the cleaning sheet 60 placed in the storing portion and stores and sets it in the predetermined sheet cassette 20*a* or 20*b* of the sheet feeding device 20. Next, the user inputs an instruction for execution of the cleaning mode on the operation panel 130. Consequently, the cleaning sheet 60 is sent to the fixing device 30 by the sheet feeding device 20 through the image producing device 10.

In this case, the fixing device 30 is driven to rotate under the same conditions as those at the time of normal fixing (a speed for plain paper or a speed for OHP sheet) and, at the same time, is heated to a fixing temperature. In addition, in the case in which the unfixed toner image 65 is formed on the cleaning sheet 60, the predetermined dot-like or line-like toner image 65 is transferred to be formed on the cleaning sheet 60 through the image forming process as described above when the cleaning sheet 60 passes through the image producing device 10.

The cleaning sheet 60 delivered to the fixing device 30 passes through the fixing nip portion between the heated heating roll 32 and the pressurizing roll 33. At this point, if there is an aggregate adhering to the surface of the heating roll 32, the aggregate is removed as if it is attracted by the cleaning sheet 60.

Figure 8A:
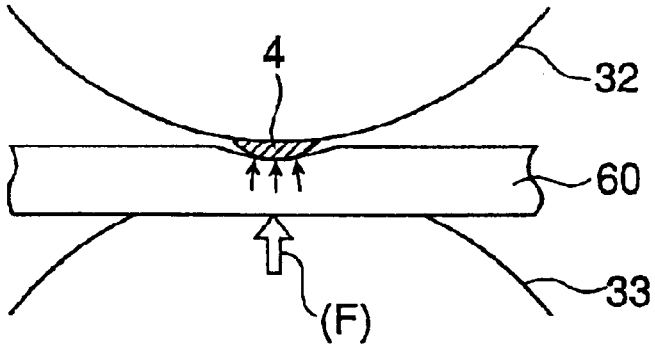
FIG. 8A schematically illustrates a state concerning a removal effect for removing an aggregate in a fixing nip portion of a cleaning sheet on which a toner image is not formed, and FIG. 8B schematically illustrates the same state in a fixing nip portion of a cleaning sheet on which a toner image is formed.

FIG. 8A schematically shows a state in which the cleaning sheet 60 on which the toner image 65 is not formed is passing the fixing nip portion. As described already, it is surmised that, since the cleaning sheet 60 in the fixing nip portion never melts and softens or deforms significantly, a pressing force F applied by the pressurizing roll 33 is almost directly applied to the aggregate 4 through the sheet 60 (as indicated by small arrow), whereby the aggregate 4 itself warps, the surface of the heating roll 32 also warps locally, and a gap is formed between the aggregate 4 and the surface of the heating roll 32. Then, the aggregate 4 is peeled from the surface of the heating roll 32 under a state in which the aggregate 4 is attracted to the cleaning sheet 60 side.

Figure 8B:
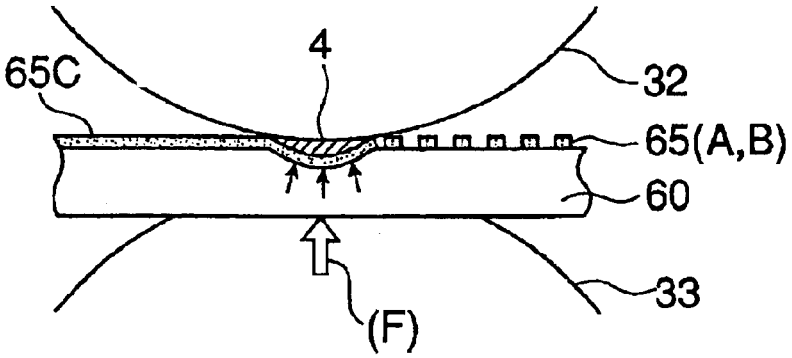

FIG. 8B schematically shows a state in which the cleaning sheet 60 on which the toner image 65 (A, B) is formed is passing through the fixing nip portion. In this case, again, it is surmised that, since the cleaning sheet 60 in the fixing nip portion never melts and softens or deforms significantly, a pressing force F applied by the pressurizing roll 33 is almost directly applied to the aggregate 4 through the sheet 60 (as indicated by small arrow), whereby the aggregate 4 itself warps, the surface of the heating roll 32 also warps locally, and a gap is formed between the aggregate 4 and the surface of the heating roll 32.

In this case, it is surmised that, in addition to this state, a toner of the dot-like or line-like toner image 65 (A, B), which is fixed and formed in advance or formed by the image producing device 10, is melted again or melted for the first time by heating equivalent to a fixing temperature from the heating roll 32, thereby being brought into a state in which the toner is spread out in the fixing nip portion to take a film shape 65C and in press contact with the aggregate 4 so as to wrap it. As a result, the melted toner functions as an agent of attracting the aggregate 4, which is about to be peeled due to the gap, with adhesive power or the like of the toner to draw it to the cleaning sheet 60 side, whereby the aggregate 4 is peeled from the surface of the heating roll 32 easily.

Thereafter, the cleaning sheet 60, which has attracted and removed the solid body 4, is discharged to the sheet discharge tray section 101 outside the apparatus. Usually, it is sufficient to pass only one cleaning sheet 60, but plural cleaning sheets may be caused to pass, if necessary. In this case, it becomes possible to remove an aggregate more surely.

Next, each test using this printer will be described.

Figure 9A:
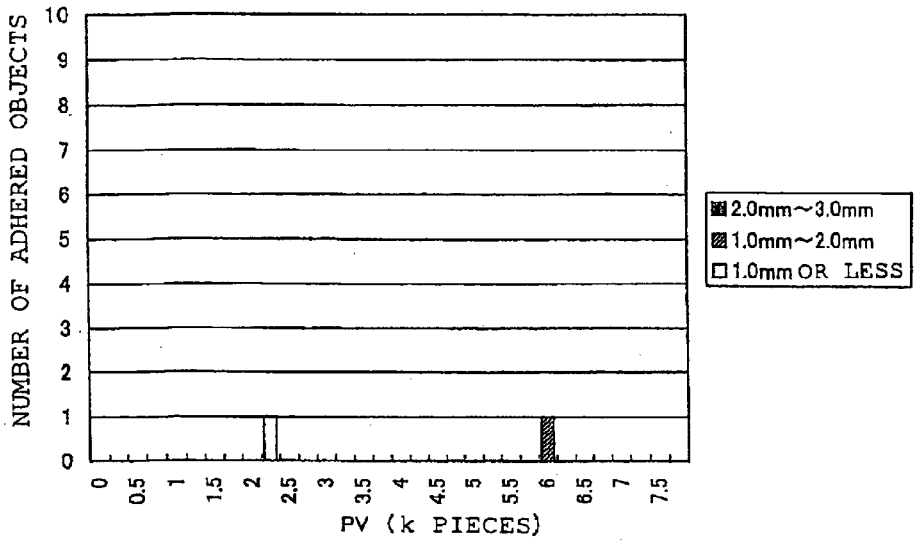
FIGS. 9A and 9B are graphs showing test results on frequency of generation of an aggregate in the case in which different recording sheets are used, respectively.
Figure 9B:
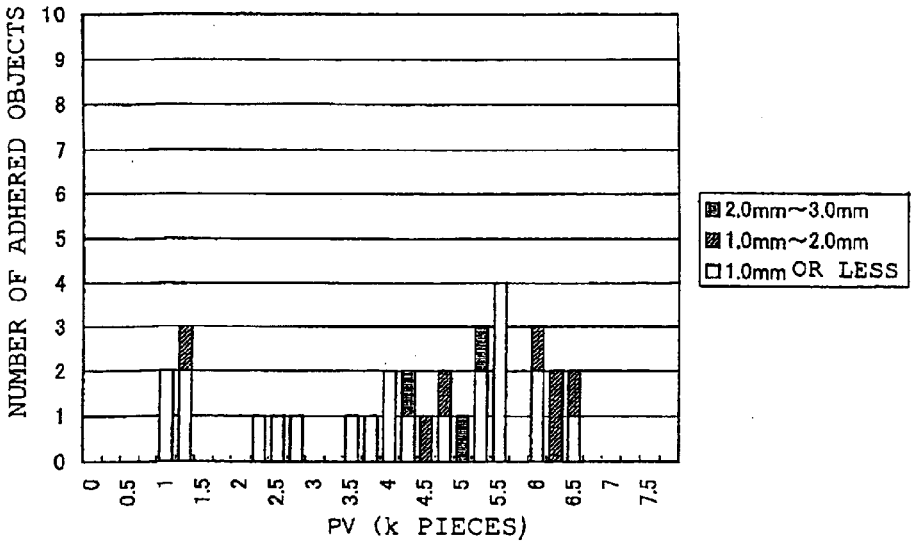

First, a state of generation of an aggregate was investigated. Copy sheets PA (manufactured by Fuji Xerox Office Supply: P paper) and copy sheets PB (manufactured by Boise: X-9000) were used as recording sheets, and same test toner images were formed on both of these sheets and fixed by the fixing device 30. Then, the surface of the heating roll 32 was observed for every 500 sheets to check how many aggregates (adhered objects) of what size (in a part of maximum dimension) existed. As a result, results as shown in FIGS. 9A and 9B were obtained. FIG. 9A shows a result of the copy sheet PA and FIG. 9B shows a result of the copy sheet PB.

As it is evident from the results of FIGS. 9A and 9B, it is seen that there is a difference in frequency of generation of an aggregate according to the type of a recording sheet to be used.

Figure 10A:
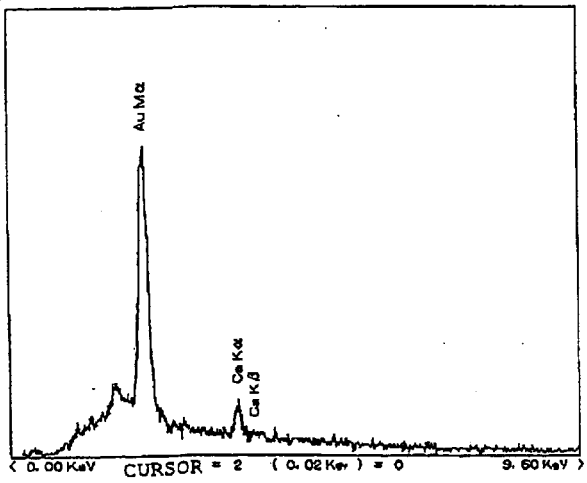
FIGS. 10A and 10B are graphs showing results concerning element analysis of the recording sheets used in FIGS. 8A and 8B, respectively.
Figure 10B:
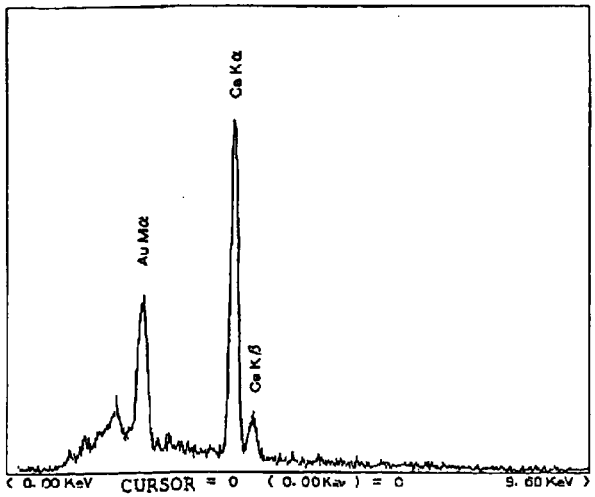

Thus, when element analysis of EDS was performed for these two types of sheets (surface) (measuring device JEOL: JED-2001), results as shown in FIGS. 10A and 10B were obtained. FIG. 10A shows a result of the copy sheet PA and FIG. 10B shows a result of the copy sheet PB.

As it is evident from the results, it is seen that the amounts of calcium are different significantly. The amount of calcium of the P paper with lower frequency of generation of an aggregate is about ⅓ of the amount of gold (Au) used serving as a reference, whereas the amount of calcium of the copy paper PB (X-9000) with higher frequency of generation of an aggregate is about twice as large as the amount of gold used. From these results, as a recording sheet, when the amount of calcium component in calcium carbonate serving as a filler exceeds ⅓ of gold according to an element analysis, it is possible that generation of an aggregate becomes gradually conspicuous.

Incidentally, when the surfaces of both sheets were observed with a microscope, only a small amount of calcium carbonate could be confirmed in a pulp fiber confounded body in the copy sheet PA (in a state in which calcium carbonate is spread out and adheres on the fiber), whereas it was confirmed that a large amount of calcium carbonate existed in a pulp fiber confounded body on the surface of the copy sheet PB as if the calcium carbonate was twined around the pulp fiber confounded body in an unchanged particle state.

Subsequently, various kinds of cleaning sheets were used as the cleaning sheet 60 to check the removal effect for removing a solid body.

As a cleaning sheet, those including materials, thicknesses, melting points, Rockwell hardness, presence or absence of a toner image as shown in FIG. 11 were used. As a toner image, a dot image (halftone dot image), in which dots were arranged like a parallel line pattern with the number of screen lines of 141/inch and a screen angle of 40° (angle formed with respect to a main scanning direction at the time of image exposure), was formed in advance. In addition, a one component magnetic toner including styrene acrylic resin containing 40 weight % of iron oxide based magnetic powder was used as a toner.

Sheets of Nos. 1 and 2 have a smooth surface, and a volume resistivity thereof is adjusted to approximately 10 logΩ.cm by scattering a conductive agent. Sheets of Nos. 3 to 5 are OHP sheets (JE-001 for PPC) manufactured by Fuji Xerox Office Supply. These sheets have a layer structure in which an electrical conductive layer with a thickness of approximately 0.1 μm and an image receiving layer with a thickness of approximately 0.1 μm including mat particles with a diameter of about 2 μm interspersed therein are formed on both sides of the sheets in this order, respectively. A surface resistance thereof is adjusted to approximately 10 logΩ.cm. All of sheets of Nos. 6 to 9 are OHP sheets or the like (item numbers thereof are PP2500, CG3300, V516, and CG3720 for the sheets of Nos. 6 to 9, respectively) manufactured by 3M. Sheet No. 10 is coated paper for printing (manufactured by Oji Paper Co., Ltd.: mirror coat) and is caused to travel such that a coated surface thereof comes into contact with a heating roll. Sheet No. 11 is cleaning paper formed by adhering non-woven fabric of acrylic resin to both sides of a base material (manufactured by Taiho Industries Co., Ltd.: cleaning paper NT-120).

Conditions for the fixing device 30 were set as described below. As the heating roll 32, a roll with an overall external diameter of 25 mm was used in which a surface release layer made of PFA including a tube with a thickness of 20 μm and surface roughness Ra of 1.0 μm or less is formed on a cylindrical cored bar made of iron (high tension steel) with a thickness in a thinnest part of 0.16 mm and a length in axial direction of 337 mm. As the pressurizing roll 33, a roll with an overall external diameter of 25 mm and roll hardness of approximately 50 degrees (Hc) was used in which an elastic layer made of silicone rubber is formed on a cylindrical cored bar made of stainless steel and a surface release layer made of PFA (electrical conductivity is given) including a tube with a thickness of 30 μm and a resistance value of $10^7$ Ω or less is formed on the elastic layer.

In addition, as the halogen lamp 34, a halogen lamp with a rated input voltage of 100V and a lamp rated electric power of 750W was used. A fixing temperature was set to approximately 190° C. A fixing speed was set to 91 mm/sec.

Then, the copy paper B was used as a recording sheet and, after performing fixing for 300 sheets, the respective cleaning sheets or the like were caused to pass the heating roll 32 on which an aggregate (with an average maximum dimension of 2 mm) was adhered. The surface of the heating roll 32 after the sheets passed was observed to check a removal effect for removing the aggregate (cleaning effect) and evaluate the effect according to criteria described below.

A: The aggregate was completely removed.

B: Most of the aggregate was removed, although a little remains.

C: The aggregate remains without being removed.

From FIG. 11, comparing the results of the sheets Nos. 1 and 2, it is seen that the removal effect can be obtained when the thickness of the sheet is increased. In addition, it is also seen from the results of the sheets Nos. 3 and 6 to 9 that the removal effect can be obtained with the thickness of 100 μm or more, and the removal effect increases more when the sheet becomes thicker like the sheets Nos. 2 and 4. On the other hand, as in the sheets Nos. 10 and 11, it is seen that the removal effect cannot be obtained even if a sheet material with a thickness exceeding 100 μm is used.

Figure 15:
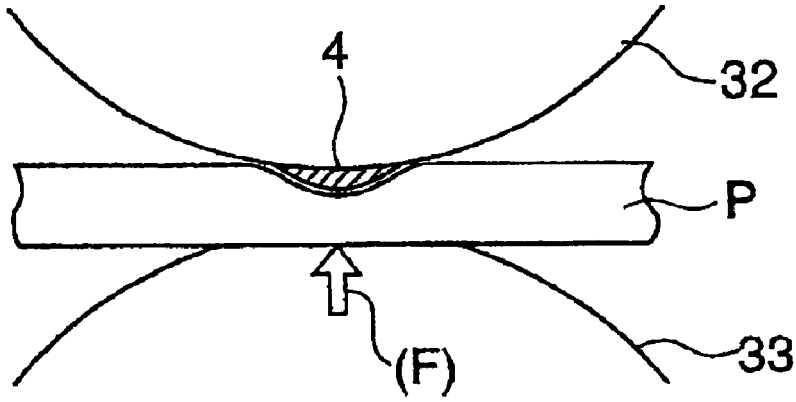
FIG. 15 is an explanatory view schematically showing a state concerning the removal effect in a fixing nip portion for a recording sheet such as plain paper.

It is considered that the removal effect cannot be obtained because a soft sheet material such as paper is crushed by an aggregate in the fixing nip portion to deform, and a pressurizing force from the pressurizing roll 33 cannot be applied to the aggregate. Actually, it has been confirmed that, when the recording sheet P such as the coated paper of No. 10 is caused to pass, as illustrated in FIG. 15, the recording sheet P is discharged from a fixing device under a state in which it deforms to be collapsed largely in a paper part opposed to the aggregate 4.

In addition, comparing the sheets Nos. 3 and 5, it is seen that the removal effect increases by forming a toner image even if the sheets have the same thickness.

Next, an aggregate with an average maximum dimension of 5 mm or more was formed on the heating roll 32, and the sheet No. 5 and sheets described in FIG. 12 were caused to pass as a recording sheet under the same conditions as above, respectively, to the heating roll 32 to check the removal effect of an aggregate in the same manner. In this case, the above-mentioned large aggregate was formed by collecting relatively small aggregates adhering on a temperature detection element or a peeling pawl due to the traveling operation for 3000 sheets performed for the formation of an aggregate, and introducing an aggregate of the aggregates into the fixing nip portion to cause it pass through the fixing nip portion without performing travel of the recording sheets. The aggregate of the aggregates was heated and pressurized in the fixing nip portion, thereby being drawn out largely to adhere to the surface of the heating roll as a hard aggregate. A result is shown in FIG. 12.

It is seen from FIG. 12 that, when an aggregate increases in size, if a cleaning sheet is thin like the sheet No. 5, the aggregate cannot be removed even if a toner image is formed, the removal effect can be obtained by extremely making the cleaning sheet thick like a sheet No. 12, and the removal effect is improved more if a toner image is formed as in a sheet No. 13.

Figure 13A:
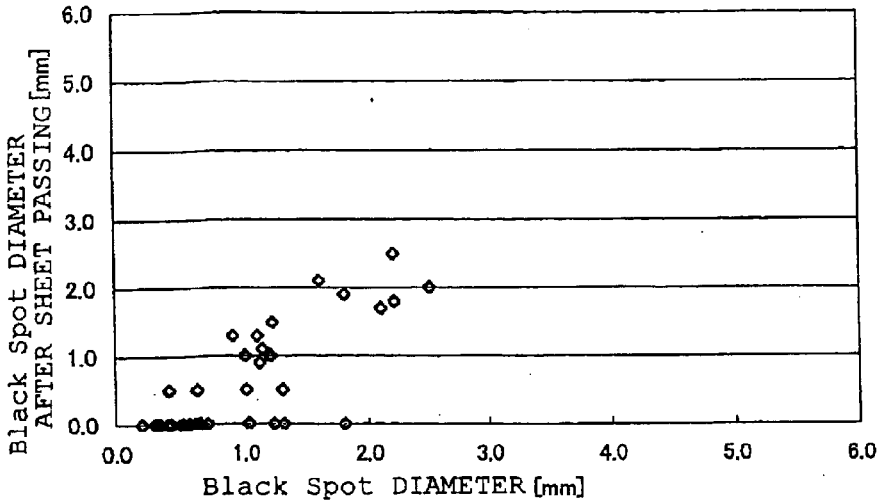
FIGS. 13A and 13B are graphs showing the removal effect for removing an aggregate in the case in which different cleaning sheets are used, respectively.
Figure 13B:
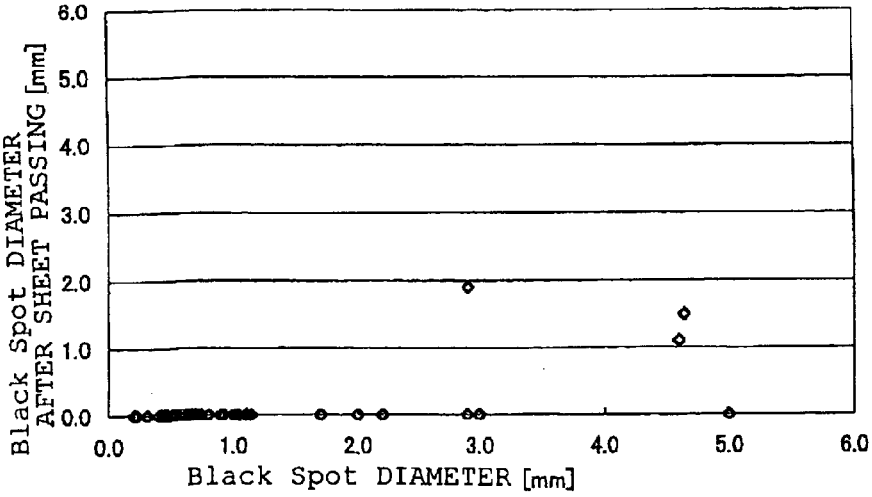
Figure 14A:
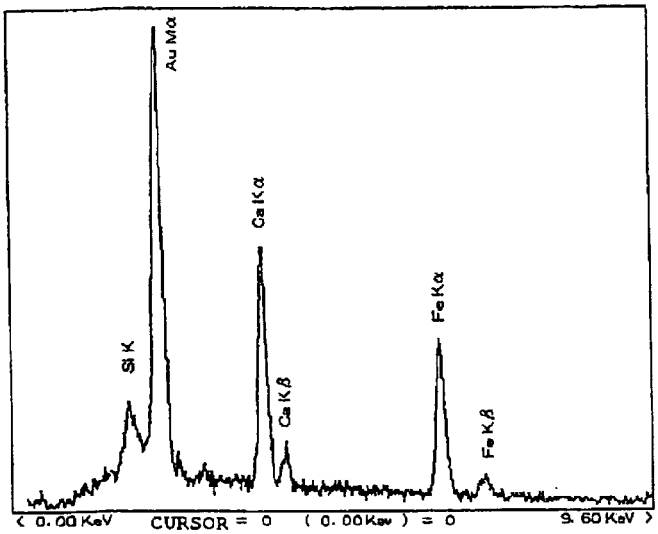
FIGS. 14A and 14B are graphs showing results concerning element analysis of adhering substance on a temperature detection element and a sheet peeling pawl, respectively.
Figure 14B:
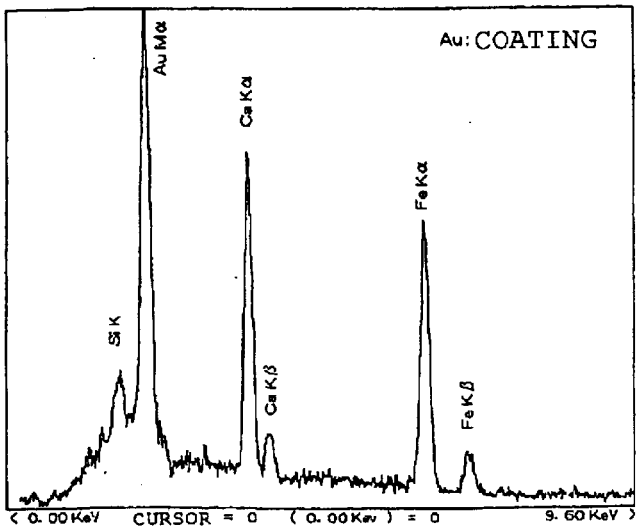

FIGS. 13A and 13B show results of investigating the removal effect of an aggregate at the time when the sheets Nos. 3 and 5 are used in terms of change in size of toner adhesion soil (black spot) remaining on the sheets. That is, the horizontal axis in the figure indicates diameters of respective black spots existing on a blank recording sheet after passing through a fixing device but before causing a cleaning sheet to travel and pass, and the vertical axis indicates diameters of respective black spots, which existed in the previous positions when a blank recording sheet was caused to pass in the same manner after the cleaning sheet was caused to travel and pass only once. FIG. 13A shows a result for the sheet No. 3, and FIG. 13B shows a result for the sheet No. 5.

It is seen from the results of FIGS. 13A and 13B, even in the case in which any cleaning sheet was used, all the diameters of the black spots are reduced, and the removal effect to some extent was obtained. In particular, in the case of the cleaning sheet No. 3 on which no toner image is formed, an aggregate up to a size of less than approximately 1.0 mm can be removed and, on the other hand and, in the case of the cleaning sheet No. 5 on which a toner image is formed, an aggregate up to a size of approximately 3 mm can be removed. In addition, it has been confirmed that, in the case of any sheet, all aggregates can be removed by causing plural sheets to travel and pass.

Note that the printer of this embodiment can be constituted such that the cleaning sheet 60 is enclosed in a package of the process cartridge 120, which is prepared as a spare cartridge for replacement, and when replacement and mounting work of the cartridge 120 is completed, the above-mentioned cleaning mode is executed in the same manner using the enclosed cleaning sheet 60.

In addition, in this embodiment, the cleaning sheet 60 may be enclosed together with an operation manual or a sheet service accessory kit (including a postcard sheet, an envelope, color paper, and the like for trial as courtesy) for the printer and taken out at the time when the cleaning mode is executed.

Further, in this embodiment, an aggregate can be removed under substantially the same conditions as the cleaning mode by, at the time of test print after maintenance work or at the time of status print for confirmation of set contents of a printer, using the cleaning sheet 60 as a recording sheet therefor.

Moreover, in this embodiment, the printer can be constituted to have a system in which, when a user is required to execute the cleaning mode, the user communicates with a service center by telephone or, in the case in which the user connects the printer to the service center via a telephone line or a network line, communicates with the service center via the line, and the service center having received the communication delivers the cleaning sheet 60 to the user. In this case, the delivery of the cleaning sheet 60 can be carried out using mail or courier or, a person in the service center can directly bring the cleaning sheet 60 to the user.

What is claimed is:

1. A cleaning sheet adapted to clean a surface of a heating roll in a fixing device, which causes a recording sheet bearing a toner image formed of a magnetic toner containing a magnetic material to pass through the fixing device under a state in which the recording sheet is in press contact with the surface of the heating roll having arranged thereon a contact component in contact with the surface of the heating roll and heated to a fixing temperature to rotate, to perform fixing of the toner image, comprising a synthetic resin sheet with a thickness of 100 $\mu$m or more, which is made of a thermoplastic resin with a melting point higher than the fixing temperature and Rockwell hardness of M60 or more or thermosetting resin with Rockwell hardness of M60 or more, the sheet passing through the fixing device under a state of being in press contact with the surface of the heating roll to thereby remove an aggregate mainly containing the magnetic material adhering to the surface of the heating roll.

2. A cleaning method comprising: causing a synthetic resin sheet with a thickness of 100 $\mu$m or more, which is made of a thermoplastic resin with a melting point higher than a fixing temperature and Rockwell hardness of M60 or more or thermosetting resin with Rockwell hardness of M60 or more, to pass through a fixing device, which causes a recording sheet bearing a toner image formed of a magnetic toner containing a magnetic material to pass through the fixing device under a state in which the recording sheet is in press contact with a surface of a heating roll having arranged thereon a contact component to be in contact with the surface of the heating roll and heated to the fixing temperature to rotate, to perform fixing of the toner image under a state in which the synthetic resin sheet is in press contact with the surface of the heating roll to remove an aggregate mainly containing the magnetic material adhering to the surface of the heating roll.

3. A cleaning method according to claim 2, wherein the synthetic resin sheet is caused to pass through the fixing device under the same conditions as those at the time of fixing.

4. A cleaning method according to claim 3, wherein the synthetic resin sheet is caused to pass through the fixing device with a dot-like or line-like toner image formed on one side thereof.

5. A cleaning method according to claim 4, wherein the aggregate mainly containing the magnetic material has a visually recognizable size.

6. A cleaning method according claim 3, wherein the aggregate mainly containing the magnetic material has a visually recognizable size.

7. A cleaning method according to claim 2, wherein the aggregate mainly containing the magnetic material has a visually recognizable size.

8. An image forming apparatus comprising:

an image producing device which forms a toner image formed of a magnetic toner containing a magnetic material and transfers the toner image to a recording sheet; and a fixing device which causes the recording sheet on which the toner image is born by the image producing device to pass through the fixing device under a state in which the recording sheet is in press contact with a surface of a heating roll, which has arranged thereon a contact component in contact with the surface of the heating roll and is heated to a fixing temperature to rotate, to perform fixing of the toner image, the image forming apparatus having an operation mode that causes a synthetic resin sheet with a thickness of 100 $\mu$m or more, which is made of a thermoplastic resin with a melting point higher than the fixing temperature and Rockwell hardness of M60 or more or thermosetting resin with Rockwell hardness of M60 or more to pass through the fixing device under a state in which the synthetic resin sheet is in press contact with the surface of the heating roll, with the operation mode executed at a predetermined time.

9. An image forming apparatus according to claim 8, wherein, at the time of execution of the operation mode, the fixing device operates under the same conditions as those at the time of fixing.

10. An image forming apparatus according to claim 9, wherein the synthetic resin sheet has a specific dot-like or line-like fixed toner image formed on one side thereof.

11. An image forming apparatus according to claim 9, wherein, at the time of execution of the operation mode, the synthetic resin sheet is conveyed to the image producing device to form a specific dot-like or line-like unfixed toner image on one side of the synthetic resin sheet, and the synthetic resin sheet with the toner image formed thereon is conveyed to the fixing device.

12. An image forming apparatus according to claim 11, wherein, at the time of image formation for test or confirmation of setting, the operation mode is executed by using the synthetic resin sheet as a recording sheet therefor.

13. An image forming apparatus according to claim 8, wherein the operation mode is executed based upon judgment of a user.

14. An image forming apparatus according to claim 8, wherein the operation mode is executed at the time when a replacement part is mounted.

15. An image forming apparatus according to claim 8, further comprising an accommodating section that stores the synthetic resin sheet.

16. An image forming apparatus according to claim 8, wherein:

the synthetic resin sheet is enclosed together with accessories for the image forming apparatus and stored.

17. An image forming apparatus according to claim 8, wherein:

the synthetic resin sheet is enclosed together with replacement parts for the image forming apparatus and stored.

18. An image forming apparatus according to claim 8, wherein:

the synthetic resin sheet is delivered to a user according to notification from the user to a service center.

* * * * *